US006557480B1

(12) United States Patent
Nuss

(10) Patent No.: US 6,557,480 B1
(45) Date of Patent: May 6, 2003

(54) BONDED WINDOWS

(75) Inventor: W. Philip Nuss, Covington, LA (US)

(73) Assignee: Halter Marine, Inc., Gulfport, MS (US)

( * ) Notice: Subject to any disclaimer, the term of this patent is extended or adjusted under 35 U.S.C. 154(b) by 0 days.

(21) Appl. No.: 09/666,874

(22) Filed: Sep. 20, 2000

(51) Int. Cl.[7] ..... B63B 19/00

(52) U.S. Cl. ..... 114/173

(58) Field of Search ..... 114/173, 361; 16/220

(56) References Cited

U.S. PATENT DOCUMENTS

| | | | | | |
|---|---|---|---|---|---|
| 1,809,117 | A | * | 6/1931 | Golden | 16/220 |
| 3,879,241 | A | * | 4/1975 | Butler | 156/108 |
| 4,262,960 | A | * | 4/1981 | Fifer | 296/84 R |
| 4,703,973 | A | * | 11/1987 | Fujikawa | 296/201 |
| 4,973,344 | A | * | 11/1990 | Rahrig et al. | 65/288 |
| 5,088,438 | A | | 2/1992 | Richardson | |
| 5,802,785 | A | * | 9/1998 | Crook | 52/204.53 |

* cited by examiner

*Primary Examiner*—Stephen Avila
(74) *Attorney, Agent, or Firm*—Len R. Brignac

(57) ABSTRACT

A window for a support structure, such as a hull of a freighter or tanker or other large ship having clips, studs, glue and protective ultraviolet paint.

9 Claims, 3 Drawing Sheets

BONDED WINDOWS

BACKGROUND OF THE INVENTION

The present invention relates generally to marine windows which can be made without the need for a metal frame using clips and bonding material.

DESCRIPTION OF THE PRIOR ART

Many small marine vessels utilize glass windows which may not have metal frames. However, on large marine vessels there has been a need for a system for holding the glass into the ship if the hull of the ship becomes too hot, such as because of a fire, and melts the adhesive used to hold the special tempered marine glass. Prior to this invention, it has not been possible to use frameless marine windows on large freighters and tankers the adhesives were not available which can be used today, and the clip mechanism of the present invention had not been created.

Traditionally, in large marine vessels the windows are supported by a framework which usually is made of a non-corrosive material such as aluminum or stainless steel. These metal frameworks are expensive to install, both in materials needed and time required to install the large tempered marine glass needed for freighter windows.

The present invention has been created to provide frameless tempered marine glass windows for large ships using clips and coating on the clips.

SUMMARY OF THE INVENTION

It is an object of the invention to create a marine window without a metal framework which is adhered to the ship using a landing support extending from the hull or sides of the hull and clips.

It is also an object of the invention to provide a window which is easier to install than framed windows, but provides the advantages of a framed window, in that if the glued window is exposed to high heat, thereby melting the glue, the glass will still be held in place, and not crash to the floor.

It is an object of the invention to have coated clips or a material, such as neoprene between the glass and the hull to provide a better seal between the glass of the windows and the structure supporting the windows.

Clips according to the invention can be attached to a support structure for the windows and spaced at various intervals on the supporting structure or framework, so as to prevent the glass from falling inside the ship in case there is a fire either on the interior or exterior of the ship melting the glue. The clips can be made of a composite material.

An object of the invention is to provide clips for the glass made of a noncorrosive material which can withstand prolonged exposure to the marine environment and intense sunlight.

An object of the invention is to use a strong bonding material, such as a glue, which can withstand the pounding of hurricane strength waves while keeping the glass adhered to the support structure, which can be a hull.

Clips can be coated from a variety of different materials. The coating should be of material that does not heat up substantially in direct sun. The coating should be durable and able to withstand wear and abrasion. The coating can be a dipped rubber, a neoprene, or a plastic cap placed over the clip flanges which cap is of a non-corrosive material capable of withstanding prolonged exposure to the marine environment.

BRIEF DESCRIPTION OF THE DRAWINGS

There are shown in the drawings embodiments which are presently preferred, it being understood, however, that the invention is not limited to the precise arrangements shown, wherein.

DETAILED DESCRIPTION OF THE PREFERRED EMBODIMENT

Figure 1:
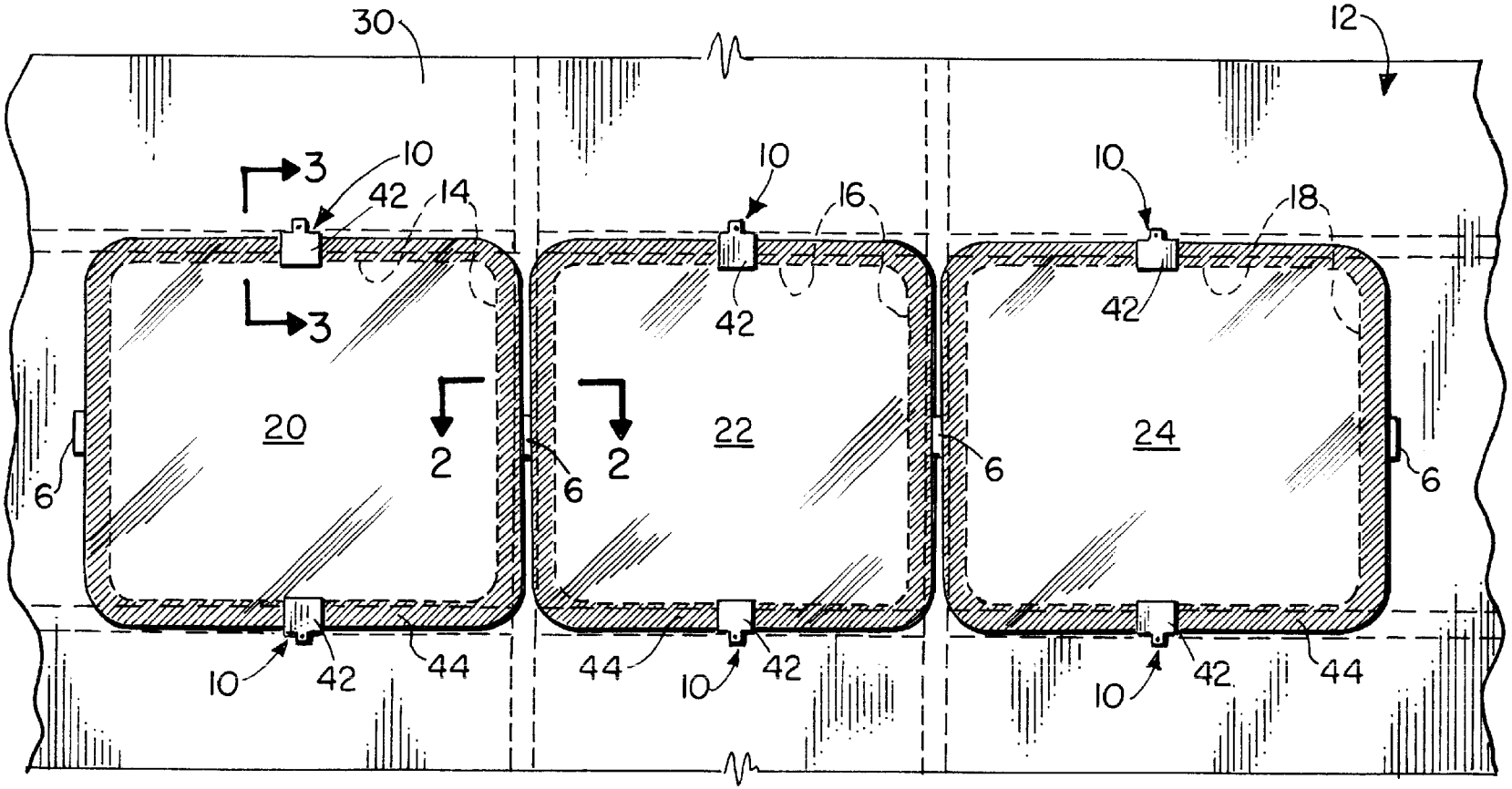
FIG. 1 is a view of this glued window on an embodiment which is a large ship.

There is shown in FIG. 1 a marine vessel having a superstructure 12 with window cutouts 14, 16 and 18 each used to support frameless windows 20, 22 and 24. The invention can be used on marine ships such as freighters, tankers, fast ferries, workboats, patrol boats, catamaran, or on offshore oil rigs, such as jack up rigs, semi-submersibles, or similar rigs. The invention is also usable on land based uses, such as wind power towers or other buildings which may require watertight windows. Other uses that are contemplated for this invention include use in airplanes which do not required pressurized cabins and other transport vehicles, such as trucks, and cars.

The present invention is contemplated as having several embodiments, one being an embodiment, where the window is on the interior of a ship, and a second embodiment being one where the window is on the exterior of a ship superstruture.

All embodiments require the formation of a landing support 10 on the support structure which holds the windows temporally prior to use of the bonding material or glue on the windows. This landing support 10 needs to be formed when the material of the superstructure is cut. The superstructure can be made from steel, aluminum, composites or combinations thereof.

The frameless windows 20, 22 and 24 can be formed having a variety of different shapes, but will commonly consist of a four-sided shape, and in the preferred embodiment is a rectangular shape. The landing support is used at the bottom part of the window.

Figure 2:
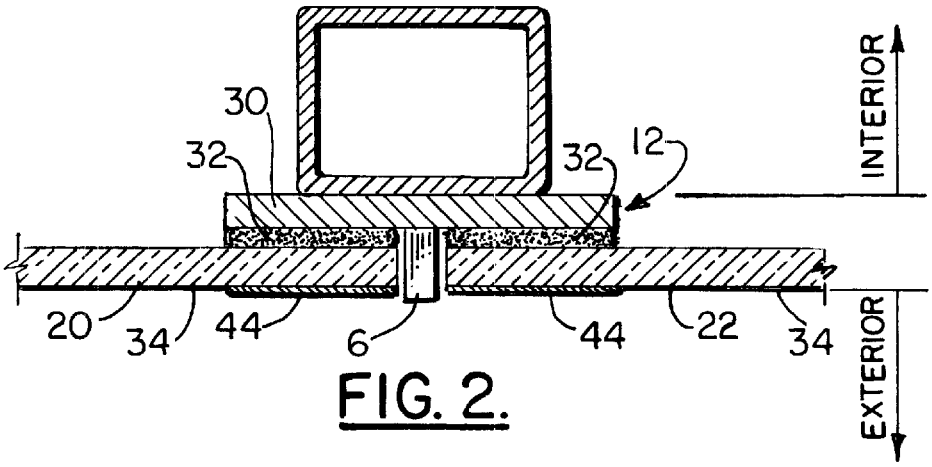
FIG. 2 is a is a section taken along lines 2–2 of FIG. 1.
Figure 3:
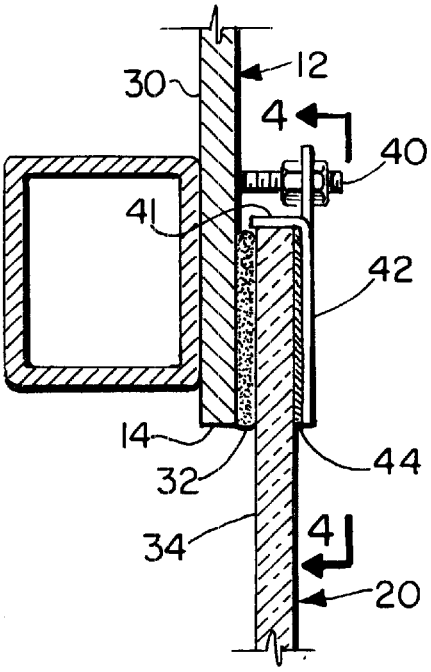
FIG. 3 is a section taken along lines 3–3 of FIG. 1.
Figure 4:
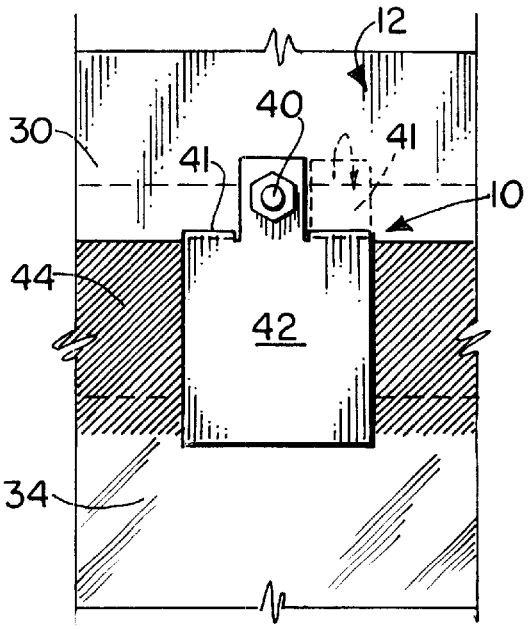
FIG. 4 is a detail view 4–4 of FIG. 3 showing a clip used to hold the tempered glass

One embodiment is shown where the clip is used on the exterior of the hull or support structure in FIGS. 2, 3 and 4. In FIG. 2, the frameless window is held in place by clip 42 and glue 32. Landing support 10 and a clip 42 are adapted to support the marine glass window, which is preferably tempered monolithic glass plates, having a minimum flexural strength of 17,200 PSI and a minimum flexural modulus of 10,6000,00 PSI. Clip 42 forms a rigid support for the glass 34. Glue 32 can be used to adhere the glass 32 to the bulkhead 30 or wall of the vessel. A preferred glue is one from Sika Corp. glue known as Sikaflex 296 available from Sika Ltd., Watchmead, Wellwin Garden City, Hertz, AL 71BQ; Sikaflex 296 is a strong marine glue capable of withstanding a corrosive environment. The clip 42 is held on to the bulkhead 30 by stud 60 which can be attached to the superstructure by welding. Additionally, a UV protective paint can be coated on the side of the glass which the glue is not adhered to. The paint is applied in a way of the adhesive on the opposite side of the plate from which the adhesive is applied. The most preferred glue is Sikaflex 296, and various thicknesses of glue can be used, preferably the thickness can range from 2–15 mm, and most preferably be 5–12 millimeters in thickness. Up to an inch of glue could be needed for very large windows, such as those used on cruise ships. Vertical stop 6 supports side of the windows.

FIG. 3 shows a detailed view of the glued windows wherein a support structure, such as a steel bulkhead 30, has a stud 40 L shaped clip 42 is used to engage glass plate 34 on one edge. Glue 32 is used to bond the glass plate 34 to the bulkhead 30.

FIG. 4 shows a detail of clip 42 and stud 40 wherein the clip has a flange end with a bendable tab 41 to bend the clip over the plate glass. Additionally, an ultraviolet protective paint 44 can be disposed on the glass plate 34 to prevent the glue from degrading.

In a preferred embodiment, the paint can be applied directly on the glass plate to prevent the adhesive degradation. Any UV protective paint that will be opaque and adhere on the glass can be used in this invention.

Figure 5:
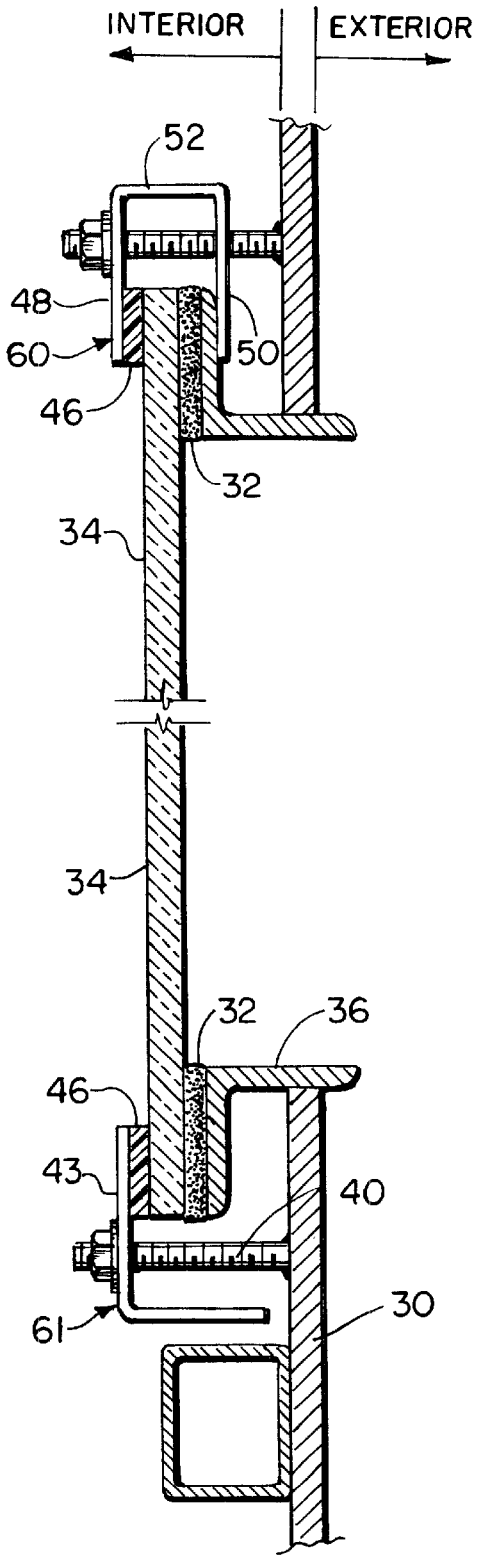
FIG. 5 is a detail view of an alternate embodiment of a window using a neoprene material between the supporting structure and the glass.

FIG. 5 shows still another embodiment of this invention using two different shaped clips 60 and 61. In the upper portion of the figure, the clip 60 is U shaped. In the lower portion of the FIG. 5, the clip 61 is L shaped.

FIG. 5 shows glass plate 34 having an material 46, such as neoprene, disposed between a flange 48 of the clip 60 and the glass 34 as well as disposed between the mounting framework 36 and the glass. The clips 60 and 61 can be formed from any of several suitable materials, which may include composites. Material 46 can be attached directly to the glass 34 by bonding with a yet another adhesive. Alternatively, it is possible to integrally form the clips 60 and 61 and material 46 in a one-piece construction, such as by creating a one-piece injection molded attaching means. In the lower portion of FIG. 5, the mounting framework 36 is shown to which glue 32 is applied and then the glass 34 is adhered to the glue. Over the glass, on the interior side of the window, the clip 61 is shown having an L shape, and between the flange 43 of clip 61 is disposed the material 46, which can be neoprene. A stud 40 can pierce the clip 61 and be welded to the bulkhead or wall 30 which in this embodiment is preferably a steel bulkhead. The stud can be installed onto the bulkhead by welding the stud to the bulkhead.

As shown in FIG. 5, the clips 60 and 61 can be formed from several suitable constructions. The U shape construction preferably includes attachment flanges 48 and 50 and a support portion 52 spanning between ends of the attachment flanges 48 and 50. The attachment flanges 48 and 50 can be adapted to resiliently engage the glass 34, and can be of any suitable shape depending in part on the shape and thickness of the glass 34 that must be engaged. The attachment flanges 48 and 50 can be flat rectangular in construction. A plastic material or liquid rubber can be used to coat at least the inside surfaces of the attachment flanges 48 and 50 to further prevent scratching of the glass when the clip 61 is installed on the wall or superstructure or other support structure.

The material 46 can be made of several suitable materials. The material should be durable and able to withstand prolonged exposure to the marine environment and intense sunlight. The material should not have a rough texture which could possibly cut or scratch the window glass. A presently preferred material for the material 46 can be poly propylene, polyethylene, neoprene or combination thereof. Plastics and rubber compounds are also possible materials. If it is desired to forego use of neoprene or material 46, then clip 60 and 61 can also be dipped in liquid rubber instead of using material 46.

The material 46 can be attached to the clip 61 by any suitable means, including use with another adhesive. In a preferred embodiment, the material 46 is an elongated strip of neoprene material.

The invention is capable of taking several alternative embodiments without departing from the spirit or essential attributes thereof. Clamps, clasps, buckles and the like may be utilized as an alternative to the clips 61 and 61 described herein. The clip can be formed in several alternative configurations to adapt to the particular hull that must be engaged.

In an alternative embodiment, a ceramic border can be fused to the glass plate. The bonding material can be secured to the ceramic border for additional UV protection for the bonding material.

Reference should accordingly be had to the following claims, rather than to the foregoing specification, as indicating the scope of the invention.

What is claimed is:

1. A method for forming a window of glass on a support structure, said method comprising:

forming a mounting framework on the support structure to hold a glass plate having a plurality of edges;

engaging at least one clip with one edge of said glass plate;

securing said at least one clip to said mounting framework using mounting means; and interposing between said glass plate and support structure, a bonding material to securely engage said glass plate to said support structure; and coating the clip with a material to prevent scratching of said class.

2. A method for forming a window of glass on a support structure, said method comprising:

forming a mounting framework on the support structure to hold a glass plate having a plurality of edges;

engaging at least one clip with one edge of said glass plate;

securing said at least one clip to said mounting framework using mounting means; and interposing between said glass plate and support structure, a bonding material to securely engage said glass plate to said support structure;

securing said glass using mounting means comprises using a stud which is attached to the support structure and engages said mounting framework; and wherein said stud is secured using a gun, and said stud is shot through the support structure with said gun.

3. A method for forming a window of glass on a support structure, said method comprising:

forming a mounting framework on the support structure to hold a glass plate having a plurality of edges;

engaging at least one clip with one edge of said glass plate;

securing said at least one clip to said mounting framework using mounting means; and, interposing between said glass plate and support structure, a bonding material to securely engage said glass plate to said support structure and wherein said clip has L-shape.

4. A window comprising:

a glass plate for use as a window;

a support structure;

a clip having at least one flange, to resiliently engage an edge of said glass plate;

mounting means for securing said clip to a support structure;

bonding material disposed between said glass and said support structure for adhering the glass plate to the support structure; and said clip is coated with a material to prevent scratching to said glass.

5. A window comprising;

a glass plate for use as a window;

a support structure;

a clip having at least one flange, to resiliently engage an edge of said glass plate;

mounting means for securing said clip to a support structure;

bonding material disposed between said glass plate and said support structure for adhering the glass plate to the support structure; wherein said clip is L-shaped.

6. A window comprising;

a glass plate for use as a window;

a support structure;

a clip having at least one flange, to resiliently engage an edge of said glass plate;

mounting means for securing said clip to a support structure;

bonding material disposed between said glass plate and said support structure for adhering the glass plate to the support structure; wherein said support structure is a superstructure for a vessel over 100 feet in overall length.

7. A window comprising:

a glass plate for use as a window;

a support structure;

a clip having at least one flange, to resiliently engage an edge of said glass plate;

mounting means for securing said clip to a support structure;

bonding material disposed between said glass and said support structure for adhering the glass to the support structure; and wherein said clip is coated with scratch resistant material to prevent damage to said glass.

8. A window comprising:

a glass plate for use as a window;

a support structure;

a clip having at least one flange, to resiliently engage an edge of said glass plate;

mounting means for securing said clip to a support structure;

bonding material disposed between said glass and said support structure for adhering the glass to the support structure; and wherein said scratch resistant material comprises at least one of the group consisting of polypropylene, polyethylene, plastic, neoprene and combinations thereof.

9. A window comprising:

a glass plate for use as a window;

a support structure;

a clip having at least one flange, to resiliently engage an edge of said glass plate;

mounting means for securing said clip to a support structure;

bonding material disposed between said glass and said support structure for adhering the glass to the support structure;

wherein a ceramic border is disposed on the glass plate where the bonding material contacts with the ceramic border.

* * * * *